US007588251B1

(12) United States Patent
Schultz et al.

(10) Patent No.: US 7,588,251 B1
(45) Date of Patent: Sep. 15, 2009

(54) SYSTEM AND METHOD FOR PLAYING A POKER GAME

(75) Inventors: David B. Schultz, Henderson, NV (US); John R. Vallejo, Henderson, NV (US); Keith Kruczynski, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 169 days.

(21) Appl. No.: 11/223,272

(22) Filed: Sep. 9, 2005

(51) Int. Cl.
*A63F 1/00* (2006.01)

(52) U.S. Cl. ..... 273/292; 273/274; 463/13

(58) Field of Classification Search ..... 273/292, 273/274, 309; 463/13
See application file for complete search history.

(56) References Cited

U.S. PATENT DOCUMENTS 4,743,022 A 5/1988 Wood
5,356,140 A * 10/1994 Dabrowski et al. ..... 463/12
6,419,578 B1 7/2002 Moody et al.
2004/0043807 A1* 3/2004 Pennington ..... 463/13
2005/0035552 A1* 2/2005 Ibbertson et al. ..... 273/292
2005/0059451 A1* 3/2005 Shackleford ..... 463/13

* cited by examiner

*Primary Examiner*—Benjamin H Layno
(74) *Attorney, Agent, or Firm*—Vanessa J. Owen; Andrew B. Chen; Marvin A. Hein

(57) ABSTRACT

One method for playing a poker game is provided. The poker game comprises dealing an initial hand from a deck of playing cards. A player is allowed to discard and replace as few as none, and as many as all, of the cards from the initial hand. The resulting hand is evaluated to determine whether the player has a three-of-a-kind, and if so, a second draw is triggered. The second draw provides the player with another opportunity to obtain a four-of-a-kind without the need for an additional wager, by allowing the player to discard at least one card and draw a replacement card for each card discarded.

25 Claims, 6 Drawing Sheets

SYSTEM AND METHOD FOR PLAYING A POKER GAME

Embodiments disclosed herein generally relate to a system and method for playing casino-type games, and more particularly, to a system and method for playing a poker-based game.

BACKGROUND

Many variations of poker have been developed to enhance player interest and to increase the attractiveness of the wagering game. For example, bonus games have been utilized in connection with a primary poker-based game. Generally, bonus games generate additional winnings beyond that which can usually be won during the normal play of a wagering game. The opportunity to receive the additional winnings entices the player to play a particular wagering game.

However, bonus games do not provide casino game players with the opportunity to increase the chances of winning in the primary game. Additionally, bonus games are often subject to the occurrence of random conditions that are beyond the control of the casino game player. Often, the casino game player loses interest in the game before a bonus event occurs. In addition, to further entice players to continue playing, some poker-based games have been developed where the player must pay a second wager to increase his opportunity of winning in a primary based game. However, not all casino players are interested in paying for a "second chance."

What is needed is a new and interesting type of poker-based game that provides a player with an increased opportunity of winning a primary poker-based game.

SUMMARY

Briefly, and in general terms, various embodiments for playing an improved poker-based game are provided. One method for playing a poker game comprises dealing an initial hand from a deck of playing cards. The player is allowed to discard and replace none, one or more cards from the initial hand. The resulting hand is evaluated to determine whether the player has a three-of-a-kind, and if so, a second draw is triggered. The second draw provides the player with another opportunity to obtain a four-of-a-kind, without the need for an additional wager, by allowing the player to discard at least one card and draw a replacement card for each card discarded. The resulting hand is then compared to a pay table and the appropriate award is distributed to the player.

Another embodiment provides a method for playing a poker game. The method, under the control of a game player, comprises receiving one or more cards dealt from a standard deck of playing cards. As few as none, or as many as all of the received cards, are selected to remain in the hand. The cards not selected to remain in the hand are discarded and replacement cards are drawn to complete the hand. If the hand comprises a three-of-a-kind, a second draw option is triggered. The second draw option provides the player with another opportunity to obtain a four-of-a-kind, without the need for an additional wager, by allowing the player to discard at least one card and draw a replacement card for each discarded card.

Optionally, another embodiment provides a gaming machine configured to provide a poker game. The poker game comprises dealing an initial hand of cards to a player. The player is allowed to discard and replace none, or one or more cards from the dealt hand. The hand is then evaluated to determine whether it contains a three-of-a-kind, and, if so, a second draw is triggered. The second draw provides the player with another opportunity to obtain a four-of-a-kind, without the need for an additional wager, by allowing the player to discard at least one card and draw a replacement card. The resulting hand is compared to a pay table and the player is awarded the appropriate win amount.

In another embodiment, a system provides a poker game to be played in conjunction with a gaming machine. The system comprises a means for dealing a hand of five cards randomly drawn from a deck of playing cards and a means for discarding as few as none and as many as all of the five cards in the dealt hand. Each of any discarded cards is replaced by a card from the standard deck of playing cards. Additionally, the system further comprises a means for evaluating the hand to determine if a player has a three-of-a-kind, and if so triggering a second draw, wherein the player is allowed to discard at least one card and draw a replacement card for each discarded card, without the need for an additional wager, thereby providing the player with another opportunity to obtain a four-of-a-kind.

DETAILED DESCRIPTION

Figure 1:
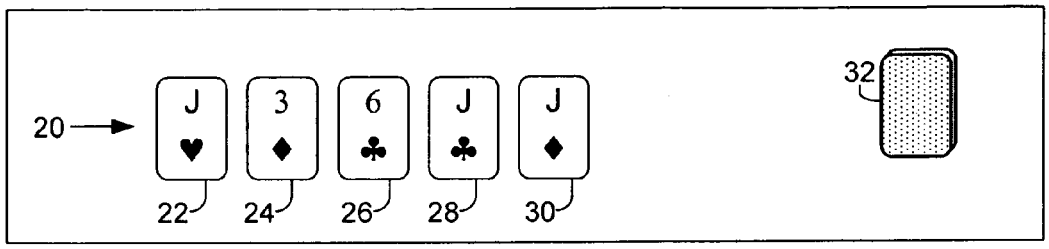
FIG. 1 illustrates an example of a hand of cards dealt to a game player in accordance with one embodiment of the poker game.

Various embodiments are directed to a system and method for playing a poker game, wherein the player is provided with at least one additional opportunity for obtaining a four-of-a-kind. Embodiments of the game system and method are illustrated and described herein, by way of example only, and not by way of limitation.

In one embodiment, a poker-based game is provided to be played in conjunction with an increased opportunity of obtaining a four-of-a-kind without the need for an additional wager. The increased opportunity is provided upon the occurrence of a triggering event. The occurrence of the triggering event provides the game player with the opportunity to generate extra winnings. Generally, the poker-based wagering game can be any casino-type poker game, which may include, but is not limited to stand alone card games or video-based poker game machines.

Associated with the poker game are triggers for activating a second draw. Generally, triggers are defined events occurring during the play of the poker game. Virtually any event can be defined as a triggering event. In one embodiment, a triggering event can be defined as a particular winning combination of cards. For example, the occurrence of a three-of-a-kind may be defined as the triggering event. The triggering event may further be defined by how the winning combination occurs. For example, if the triggering event is defined as the occurrence of a three-of-a-kind, it can be further stipulated that the three-of-a-kind must occur when the initial hand is dealt. Alternatively, in an optional embodiment, the three-of-a-kind may occur at any time. Other triggering events such as player status, time of day, wagered amount and the like may also be used to trigger a second draw to the initial hand.

Referring now to the drawings, wherein like reference numerals denote like or similar elements throughout the drawings, and more particularly to FIGS. 1-18, there is shown a system and method for playing a poker-based game.

In one embodiment, the poker-based game uses a five-card single-hold-and-draw poker game. Optionally, as those skilled in the art will appreciate, any poker-based game where a player ends up with four or more cards at the end of the game may be used.

In one embodiment, a standard deck of cards is used to play the game. Of course, one of ordinary skill in the art will appreciate that the standard deck of cards may comprise more or less than fifty-two cards. For example, a wild card may be added to the deck of cards. Alternatively, more than one wild card may be added to the deck of cards. Optionally, more than one deck of cards may be used in a game.

Referring now to FIG. 1, an example of five cards randomly dealt from a standard deck of playing cards is illustrated. Specifically, the hand 20 includes the cards 22, 24, 26, 28 and 30, all dealt from the deck of cards 32. The cards in the hand 20 are shown face-up, and appear to have been dealt all face-up. However, in one embodiment, the cards are all dealt face-down, or alternatively, the cards are dealt in a combined fashion such that some of the cards are dealt face-down and some are dealt face-up.

Once the cards have been dealt, the player is allowed to discard and to draw replacement cards for the hand 20. As those skilled in the art will appreciate, the number of allowed discards will vary for different poker-based games. In one embodiment, the game player may discard as few as none and as many as all of the cards received in the initial hand. For example, in a game where five cards are dealt to the player, then as many as five cards may be discarded. If any cards are discarded, replacement cards from the same standard deck of cards are drawn or dealt to complete the hand. The hand is then compared to a standard poker payout table to determine a payout amount. Alternatively, any type of pay table may be used.

It is important to note that the game player is not required to discard any of the cards dealt in the initial hand, and may choose to hold all of the originally dealt cards. However, in an alternative embodiment of the invention, the game player may be required to discard at least one of the dealt cards.

Figure 2:
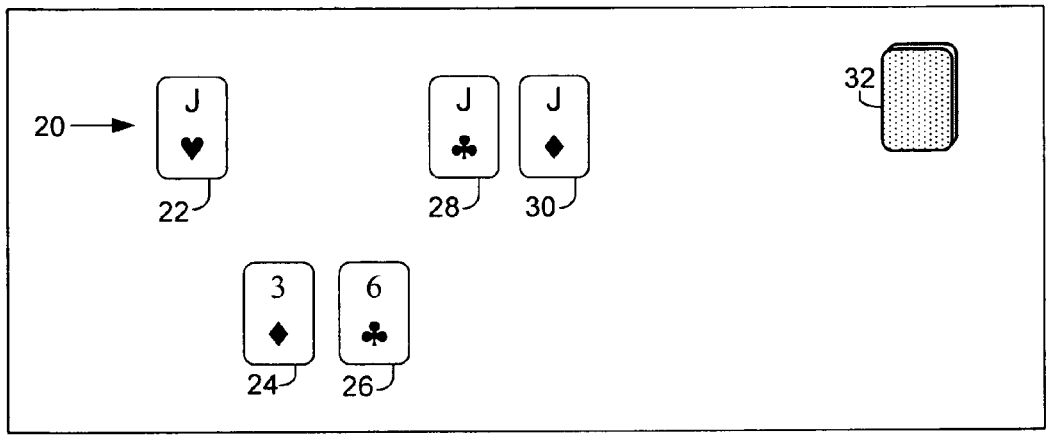
FIG. 2 illustrates a hand of cards played in accordance with an embodiment of the poker game.

For the purposes of this example, the player selects two cards to discard, which is illustrated in FIG. 2. Cards 24 and 26 are the two cards selected to be discarded, and therefore, the cards have been removed from the hand 20. Optionally, the player may select which cards remain in the hand. In this scenario, the unselected cards are treated as discards and are removed from the player's hand.

Referring back to FIG. 2, the cards 22, 28 and 30 remain in the hand 20. Two cards are drawn from the deck 32 to replace the discarded cards and to complete the hand 20. Alternatively, a dealer may deal two cards from a deck 32 to the player.

Figure 3:
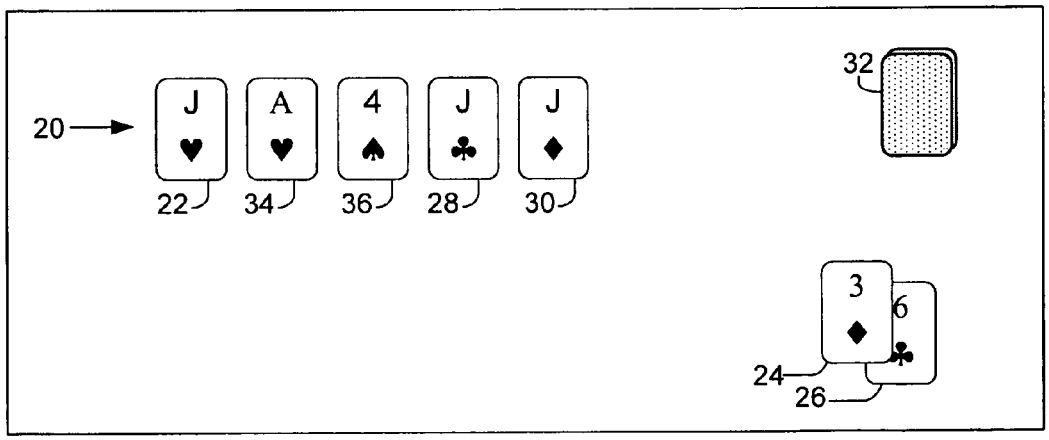
FIG. 3 illustrates a hand of cards formed in accordance with an embodiment of the poker game.
Figure 4:
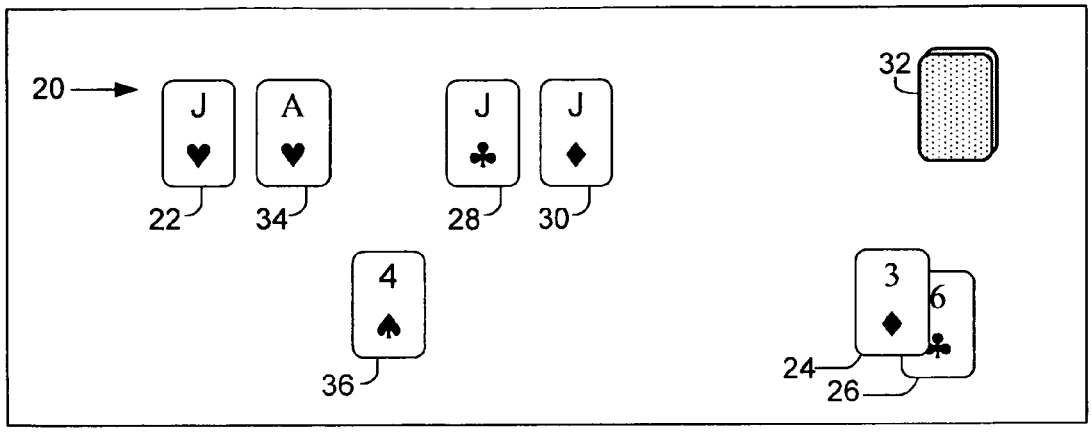
FIG. 4 illustrates a discard selection for replacement by a second draw in accordance with an embodiment of the poker game.
Figure 5:
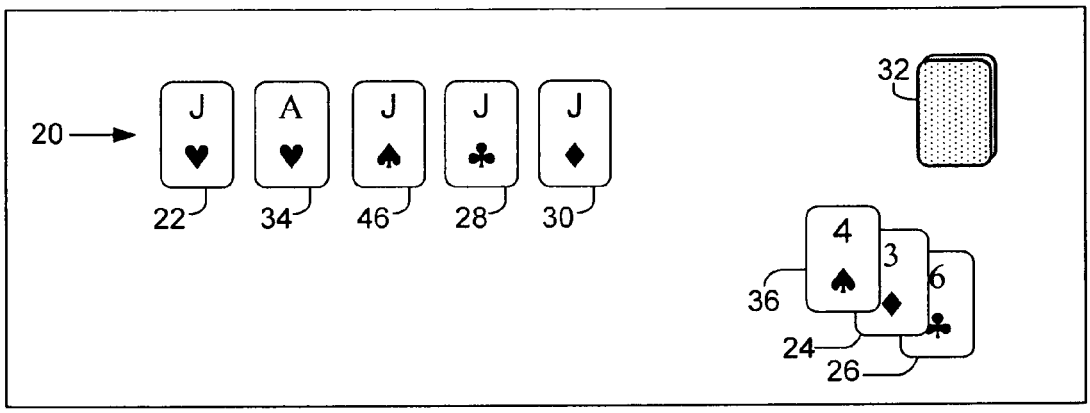
FIG. 5 illustrates the hand of cards formed after the second draw in accordance with an embodiment of the poker game.

FIG. 3 illustrates a hand 20 where the cards 34 and 36 were drawn (or dealt) from the deck 32 to complete the hand. The presence of a three-of-a-kind in the hand 20 (cards 22, 28 and 30) triggers a second draw. More particularly, the second draw option provides the player with another opportunity for obtaining a four-of-a-kind without requiring an additional wager from the player. Once the second draw is triggered, the player is allowed to discard at least one card. Referring to FIG. 4, the card 36 is selected to be discarded, and therefore, this card has been removed from the hand 20. The cards 22, 34, 28 and 30 remain in the hand 20. A replacement card 46 is drawn from the deck 32 to complete the hand 20, as illustrated in FIG. 5. The hand 20, in FIG. 5, is compared to a standard payout table and is awarded a payout accordingly. Optionally, any type of pay table may be used to determine the payout.

Figure 6:
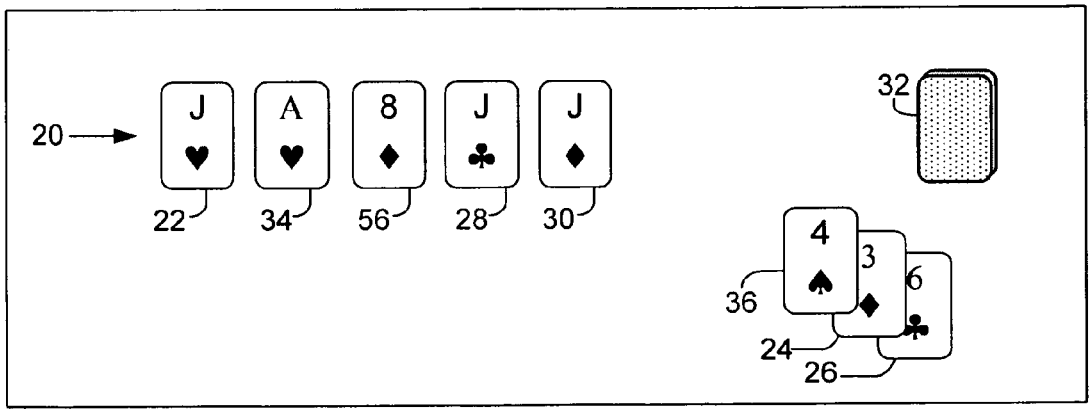
FIG. 6 illustrates another hand of cards formed after the second draw in accordance with an embodiment of the poker game.

The hand 20, as shown in FIG. 5, contains a four-of-a-kind and the player is awarded the payout that corresponds to such a hand. Optionally, the player may not obtain a four-of-a-kind. For example, referring back to FIG. 4, the player discards the card 36 from the hand 20. The player then draws a replacement card to complete the hand 20. Referring to FIG. 6, a replacement card 56 from the deck 32 completes the hand 20. The hand 20 in FIG. 6 contains a three-of-a-kind and the player is awarded an appropriate payout that corresponds to this level of win.

Figure 7:
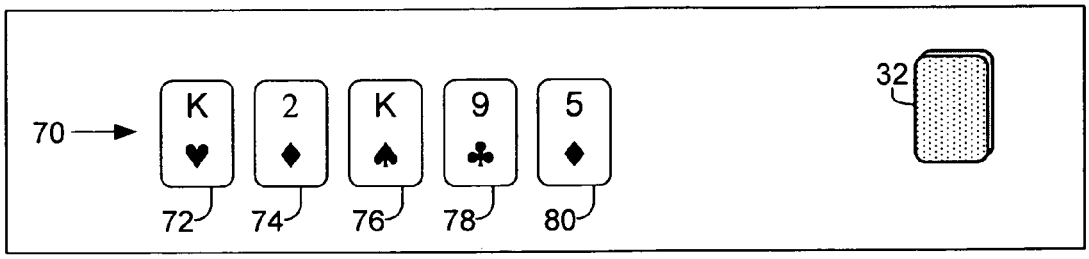
FIG. 7 illustrates an example of another hand of cards dealt to a game player in accordance with an embodiment of the poker game.
Figure 8:
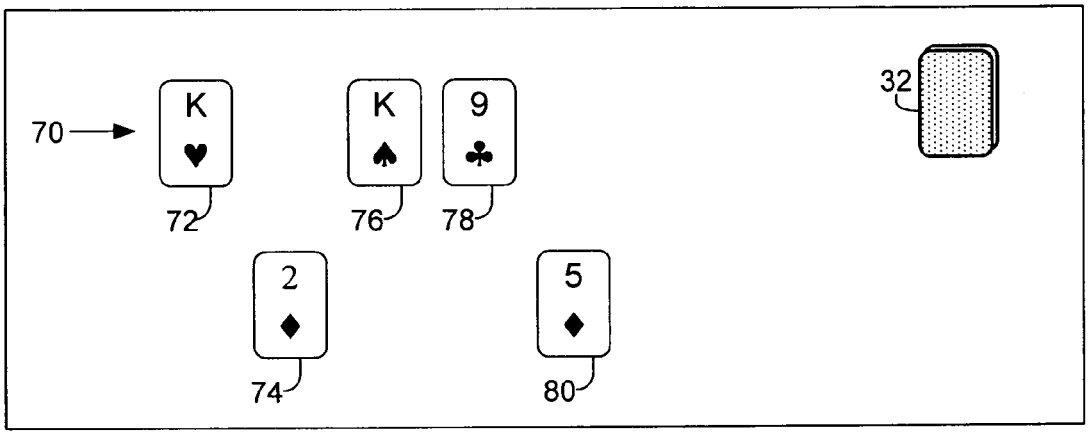
FIG. 8 illustrates a hand of cards played in accordance with an embodiment of the poker game.
Figure 9:
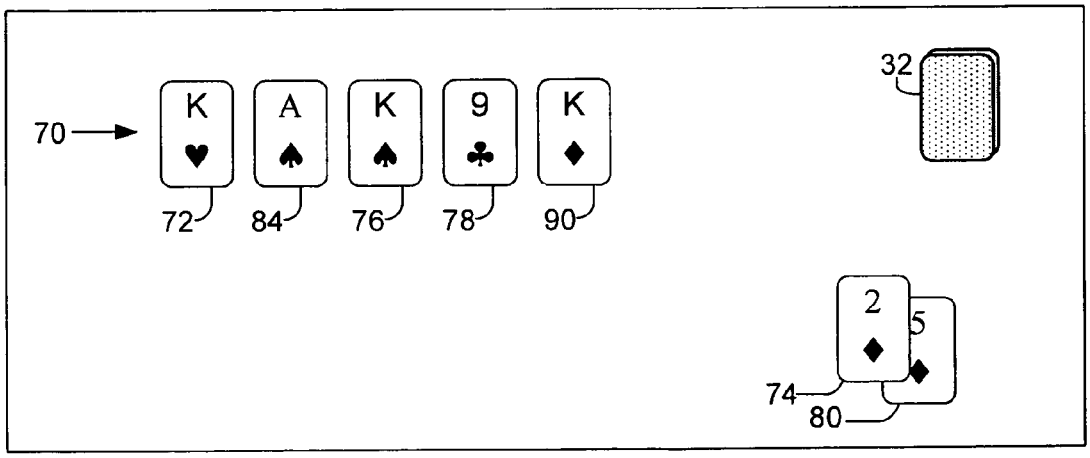
FIG. 9 illustrates a hand of cards formed in accordance with an embodiment of the poker game.
Figure 10:
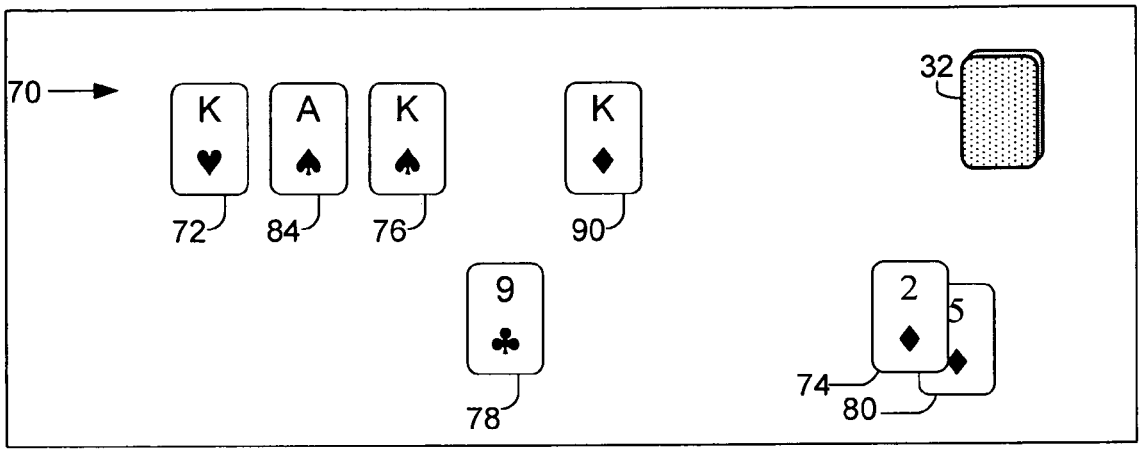
FIG. 10 illustrates a discard selection for replacement by a second draw in accordance with an embodiment of the poker game.
Figure 11:
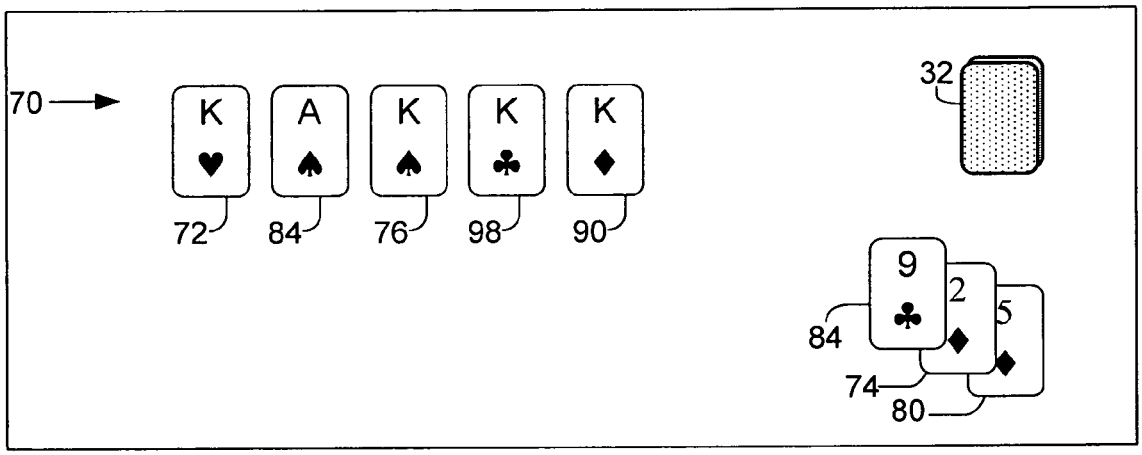
FIG. 11 illustrates the hand of cards formed after the second draw in accordance with an embodiment of the poker game.
Figure 12:
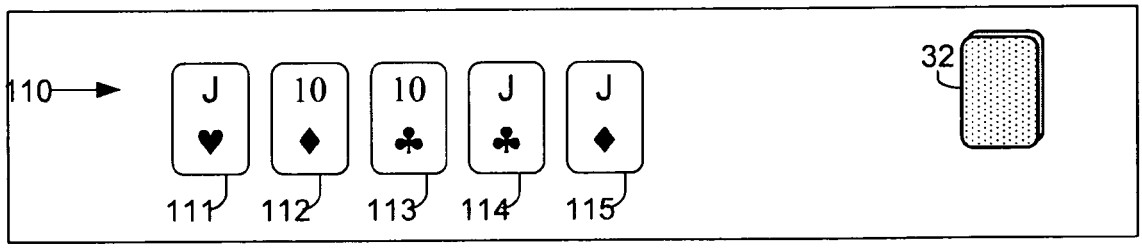
FIG. 12 illustrates a hand of cards dealt to a player in accordance with an embodiment of the poker game.

In one embodiment, the three-of-a-kind must occur on the initial deal to trigger the second draw option. For example, the hand 20 shown in FIG. 1 shows a three-of-a-kind occurring on the first deal, and in one embodiment, this occurrence would trigger the second draw option. Alternatively, in another embodiment, the three-of-a-kind does not need to occur in the initial hand and may instead be formed with the aid of replacement cards drawn during the course of the game. For example, FIG. 7 illustrates an initial hand 70 comprising cards 72, 74, 76, 78 and 80, wherein the cards 72 and 76 are a pair of kings. The player receiving the hand 70 may select which, if any, cards to discard. As previously stated, the player may also select which cards remain in the hand. In this example, the player chooses to discard cards 74 and 80. In FIG. 8, the cards 74 and 80 have been removed from the hand 70. Two replacement cards are drawn from the deck of cards 32 to complete the hand 70. FIG. 9 illustrates a hand 70 where cards 84 and 90 were drawn from the deck 32 to form the hand. The card 90 completes the formation of a three-of-a-kind (cards 72, 76 and 90) in the hand 70, the occurrence of which triggers a second draw option. Again, once the second draw option is triggered, the player is allowed to discard at least one card without having to make an additional wager. Referring to FIG. 10, the card 78 is selected to be discarded and has been removed from the hand 70. A replacement card 98 is drawn from the deck 32 to complete the hand 70, as illustrated in FIG. 11. The hand 70 shown in FIG. 11 contains a four-of-a-kind (cards 72, 76, 98 and 90). Accordingly, the player is awarded a payout according to a standard pay table. Optionally, any type of pay table may be used to determine a payout amount.

Optionally, in another embodiment, in order to trigger the second draw option, a three-of-a-kind must occur as a stand-alone result and not part of a four-of-a-kind, full house, or the like. For example, referring to FIG. 12, the complete hand 110 contains three "jacks (cards 111, 114 and 115). However, the three "jacks" are part of a full house and therefore, are not considered a three-of-a-kind for the purposes of triggering a second draw. Therefore, the presence of the three "jacks" would not trigger the second draw option.

Alternatively, triggering the second draw option requires a three-of-a-kind drawn in the initial deal and not part of another winnable combination after the hand is completed. For example, referring back to FIG. 1, an initial hand 20 is dealt to a player from the deck of cards 32. The initial hand 20 contains a three-of-a-kind (cards 22, 28 and 30) and meets the first part of the trigger requirement (i.e. the initial hand contains a three-of-a-kind). In FIG. 2, the player selects the cards 24 and 26 to discard. Two cards are then need to complete the hand 20. In FIG. 3, the player draws the cards 34 and 36 to complete the hand 20. Since a three-of-a-kind occurred on the initial deal and the three-of-a-kind is not part of another winnable combination in the complete hand 20 in FIG. 3, a second draw would be triggered.

Figure 13:
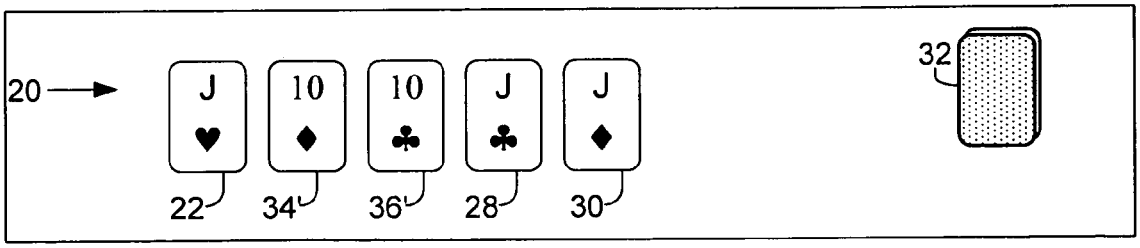
FIG. 13 illustrates an example of a hand of cards formed in accordance with an embodiment of the poker game.

However, if instead the player drew replacement cards 34' and 36' (as shown in FIG. 13) to complete the hand 20, the second draw would not be triggered. In this example, the hand 20 in FIG. 13 contains a full house (two "tens" and three "jacks"). The three jacks (i.e. cards 22, 28 and 30) would not trigger a second draw option because the three jacks are part of the full house and therefore ineligible to trigger the second draw option.

Figure 14:
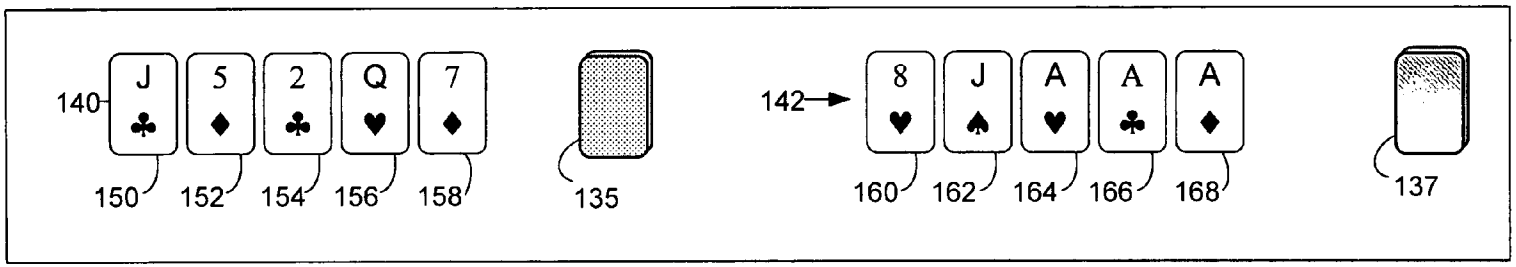
FIG. 14 illustrates multiple hands of cards dealt to a single game player in accordance with an embodiment of the poker game.

In another, separate embodiment, more than one hand of cards may be dealt to the game player, wherein each additional hand contains the same number of cards as the first dealt hand. For example, referring to FIG. 14, a first hand 140 is dealt from the deck 135 and an additional hand 142 is dealt from an additional deck 137. It will be appreciated that any number of additional hands can be dealt to the game player. FIG. 14 is provided for purposes of illustration only, and is not intended to limit or restrict the number of multiple hands to two.

Figure 15:
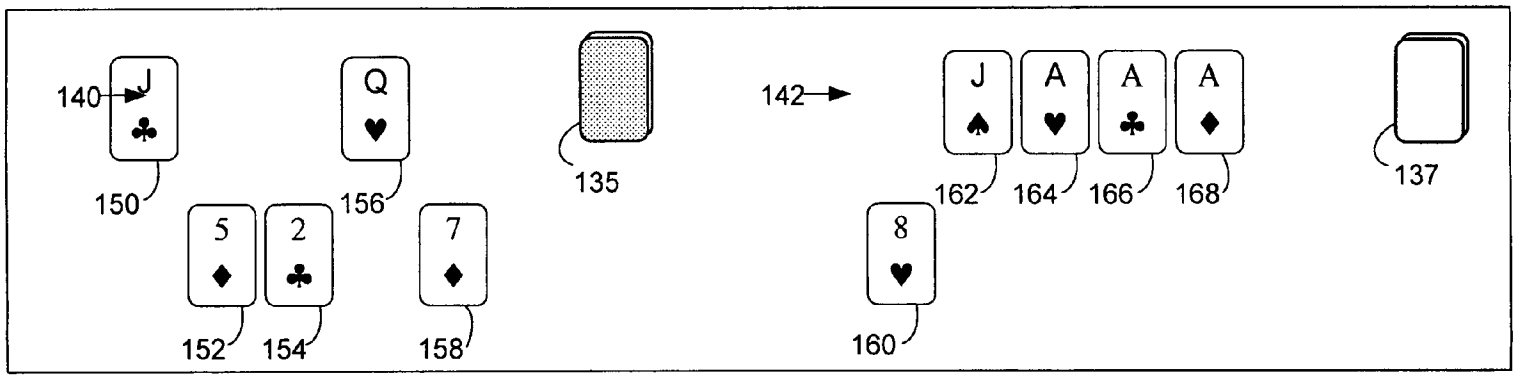
FIG. 15 illustrates playing more than one hand of cards in accordance with an embodiment of the poker game.

Referring back to FIG. 14, the game player chooses which cards, if any, to discard from each of the hands 140 and 142. The game player may choose to discard as few as none, and as many as the maximum number of allowed discards from each hand. As previously stated, the maximum allowable number of discards varies among the many variations of poker-based games. Additionally, the game player may choose to discard a different number of cards from each hand. FIG. 15 illustrates the cards removed, or discarded, from each hand. Specifically, the cards 152, 154 and 158 have been discarded from the hand 140 and the card 160 has been discarded from the hand 142.

Figure 16:
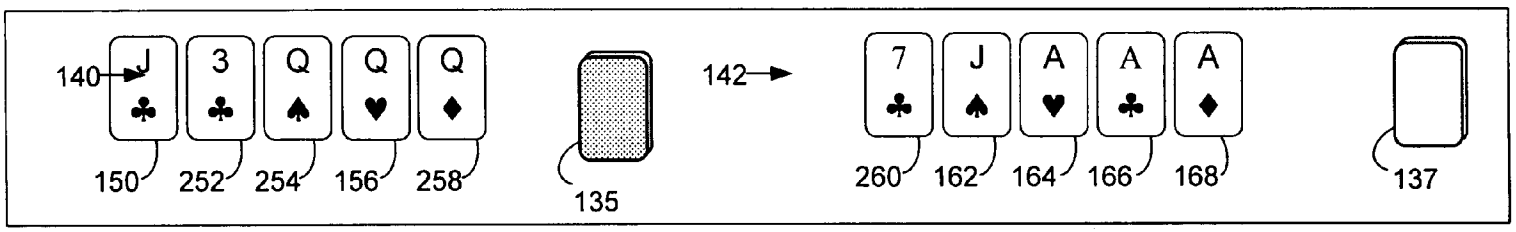
FIG. 16 illustrates playing more than one hand of cards in accordance with an embodiment of the poker game.

The three replacement cards needed to complete the hand 140 are drawn from the deck 135, which is the same deck used initially to deal the hand 140. In FIG. 16, the cards 252, 254 and 258 have been drawn from deck 135 to complete and form the hand 140. The replacement card needed to complete the hand 142 is drawn from the deck 137, the same deck used initially to deal the original hand 142. In FIG. 16, the card 260 is drawn from the deck 137 to complete and form the hand 142. The hands 140 and 142 are then evaluated.

The presence of a three-of-a-kind triggers a second draw option. As previously stated, different variants of the three-of-a-kind trigger may be utilized. For example, the three-of-a-kind may be required to occur in the initial deal hand to trigger the second draw option.

Figure 17:
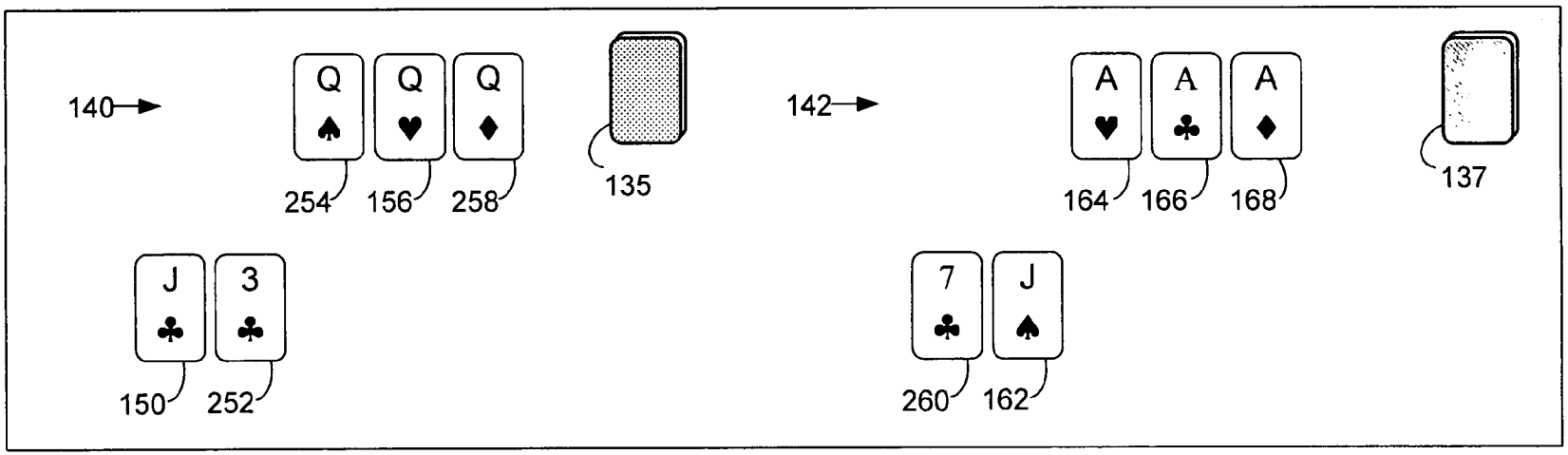
FIG. 17 illustrates playing more than one hand of cards after a second draw is triggered in accordance with an embodiment of the poker game.
Figure 18:
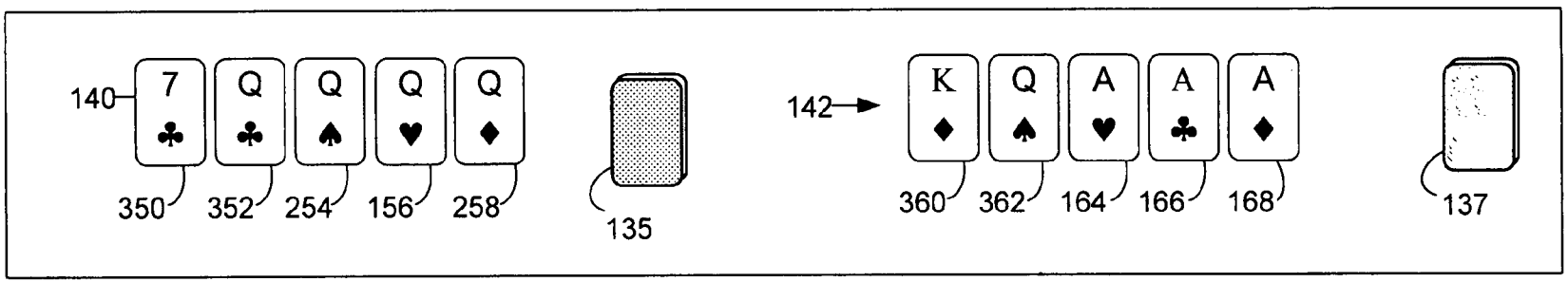
FIG. 18 illustrates playing more than one hand of cards after a second draw in accordance with an embodiment of the poker game.

Referring back to FIG. 16, both of the hands 140 and 142 contain a three-of-a-kind. For purposes of this example, the presence of each three-of-a-kind triggers the second draw option. Referring now to FIG. 17, the player may discard and replace one card from each hand. Additionally, the second draw option is presented to the player without requiring the player to make any additional wagers. Additionally, even though the second draw option is available, the player does not have to make use of this option. For the purposes of this example, however, the player chooses to discard the cards 150 and 252 from the hand 140 and the cards 260 and 162 from the hand 142. Two cards are drawn from the deck 135 to complete the hand 140 and two cards are drawn from the deck 137 to complete the hand 142. Referring to FIG. 18, the cards 350 and 352 are drawn from the deck 135 to complete the hand 142 and the cards 360 and 362 are drawn from the deck 137 to complete the hand 142. Each of the hands 140 and 142 are evaluated for winning combinations. Accordingly, the hand 140 is awarded a payout appropriate for a four-of-a-kind and the hand 142 is awarded a payout appropriate for a three-of-a-kind.

Furthermore, the various methodologies described above are provided by way of illustration only and should not be construed to limit the invention. Those skilled in the art will readily recognize that various modifications and changes may be made to the present invention without departing from the true spirit and scope of the present invention. Accordingly, it is not intended that the present invention be limited, except as by the appended claims.

What is claimed is:

1. A method for playing a poker game, the method comprising:

providing a deck of playing cards;

receiving a wager;

responsive to the wager, dealing an initial hand from the deck of playing cards;

optionally, discarding one or more cards from the initial hand;

replacing any card discarded from the initial hand with a replacement card;

enabling the additional discard option when a stand-alone result of a three-of-a-kind is shown in the initial hand and player eligibility is satisfied, wherein the additional discard option includes replacing any additional discarded card with an additional replacement card without requiring an additional wager; and awarding a payout according to a poker payout table.

2. The method of claim 1, wherein the initial hand comprises five cards.

3. The method of claim 1, wherein the initial hand comprises seven cards.

4. The method of claim 1, wherein the initial hand comprises less than seven cards.

5. The method of claim 1, wherein the initial hand is dealt from a standard deck of cards.

6. The method of claim 1, wherein the initial hand is dealt from a deck of cards comprising one or more wild cards.

7. The method of claim 1, wherein dealing the hand of cards comprises dealing each of the cards face-up.

8. The method of claim 1, wherein dealing the hand of cards comprises dealing each of the cards face-down.

9. The method of claim 1, wherein dealing the hand of cards comprises dealing a number of the cards face-up and the remaining number of the cards face-down.

10. The method of claim 1, further comprising providing the poker game on a gaming machine.

11. The method of claim 1, further comprising receiving a request to discard one or more of the dealt cards and discarding one or more of the cards requested to be discarded.

12. The method of claim 1, further comprising receiving a request to evaluate the hand of cards to determine whether a winning combination is present.

13. The method of claim 1, further comprising:

dealing one or more additional hands;

replacing any card discarded from any of the additional hands, determining whether a three-of-a-kind is shown in any of the additional hands;

ascertaining player eligibility for an additional discard option, wherein player eligibility is based on whether the wager meets a predetermined minimum wager or a player's status; and enabling the additional discard option when the three-of-a-kind is shown in any of the additional hands and player eligibility is satisfied, where the additional discard option includes replacing any additional discarded card with an additional replacement card without requiring an additional wager.

14. A method for operating a poker game, the method comprising:

providing a deck of playing cards;

receiving a wager;

responsive to the wager, dealing an initial hand from the deck of playing cards;

optionally, discarding one or more cards from the initial hand;

replacing any card discarded from the initial hand with a replacement card;

determining whether three-of-a-kind is shown;

ascertaining player eligibility for an additional discard option, wherein player eligibility is based on whether the wager is equal to or exceeds a predetermined threshold wager;

enabling the additional discard option when a three-of-a-kind is shown and player eligibility is satisfied, wherein the additional discard option includes replacing any additional discarded card with an additional replacement card without requiring an additional wager; and awarding a payout according to a payout table.

15. The method of claim 14, wherein enabling an additional discard option further comprises conditioning the enabling of the additional discard step upon determining whether a discard occurred.

16. The method of claim 14, wherein enabling an additional discard option further comprises conditioning the enabling of the additional discard step upon determining whether three-of-a-kind occurred in the initial hand.

17. The method of claim 14, wherein enabling an additional discard option further comprises conditioning the enabling of the additional discard step upon determining whether one or more of the three of a kind are not part of another winning combination according to the pay table.

18. A method for operating a poker game, the method comprising:

providing a deck of playing cards;

receiving a wager;

responsive to the wager, dealing an initial hand from the deck of playing cards;

optionally, discarding one or more cards from the initial hand;

replacing any card discarded from the initial hand with a replacement card;

determining whether three-of-a-kind is shown;

ascertaining player eligibility for an additional discard option, wherein player eligibility is based on whether the game play is equal to or exceeds a predetermined threshold period of time;

enabling the additional discard option when a three-of-a-kind is shown and player eligibility is satisfied, wherein the additional discard option includes replacing any additional discarded card with an additional replacement card without requiring an additional wager; and awarding a payout according to a payout table.

19. The method of claim 18, wherein enabling an additional discard option further comprises conditioning the enabling of the additional discard step upon determining whether a discard occurred.

20. The method of claim 18, wherein enabling an additional discard option further comprises conditioning the enabling of the additional discard step upon determining whether three-of-a-kind occurred in the initial hand.

21. The method of claim 18, wherein enabling an additional discard option further comprises conditioning the enabling of the additional discard step upon determining whether one or more of the three of a kind are not part of another winning combination according to the pay table.

22. A method for operating a poker game, the method comprising:

providing a deck of playing cards;

receiving a wager;

responsive to the wager, dealing an initial hand from the deck of playing cards;

optionally, discarding one or more cards from the initial hand;

replacing any card discarded from the initial hand with a replacement card;

determining whether three-of-a-kind is shown;

ascertaining player eligibility for an additional discard option, wherein player eligibility is based on whether a player status is equal to or exceeds a predetermined threshold player status value;

enabling the additional discard option when a three-of-a-kind is shown and player eligibility is satisfied, wherein the additional discard option includes replacing any additional discarded card with an additional replacement card without requiring an additional wager; and awarding a payout according to a payout table.

23. The method of claim 22, wherein enabling an additional discard option further comprises conditioning the enabling of the additional discard step upon determining whether a discard occurred.

24. The method of claim 22, wherein enabling an additional discard option further comprises conditioning the enabling of the additional discard step upon determining whether three-of-a-kind occurred in the initial hand.

25. The method of claim 22, wherein enabling an additional discard option further comprises conditioning the enabling of the additional discard step upon determining whether one or more of the three of a kind are not part of another winning combination according to the pay table.

* * * * *